US009408521B2

(12) United States Patent
Molinet et al.

(10) Patent No.: US 9,408,521 B2
(45) Date of Patent: Aug. 9, 2016

(54) CONTINUOUSLY CURVING CLEANING ELEMENT

(71) Applicant: 3M INNOVATIVE PROPERTIES COMPANY, St. Paul, MN (US)

(72) Inventors: Michael C. Molinet, Stanford, CA (US); Trevor Chipman, Minneapolis, MN (US); Jeffrey S. Fox, White Bear Township, MN (US); Kayo M. Roehm, Shoreview, MN (US); Cynthia A. Timmerman, Hudson, WI (US); Martin E. Broen, Milan (IT); Johannes Bayer, Balgach (CH)

(73) Assignee: 3M Innovative Properties Company, St. Paul, MN (US)

( * ) Notice: Subject to any disclaimer, the term of this patent is extended or adjusted under 35 U.S.C. 154(b) by 516 days.

(21) Appl. No.: 13/785,042

(22) Filed: Mar. 5, 2013

(65) Prior Publication Data

US 2014/0013527 A1 Jan. 16, 2014

Related U.S. Application Data

(60) Provisional application No. 61/669,899, filed on Jul. 10, 2012.

(51) Int. Cl.
*A47L 17/00* (2006.01)
*A47L 17/08* (2006.01)

(52) U.S. Cl.
CPC ..... *A47L 17/00* (2013.01); *A47L 17/08* (2013.01); *Y10T 29/49826* (2015.01)

(58) Field of Classification Search
CPC ..... A47L 13/16; A47L 13/17; A47L 13/253; A47L 13/258; A47L 17/00; A47L 17/04; A47L 17/08; A45B 5/002; A45B 5/0041; A45B 5/0045
USPC ..... 401/9, 261
See application file for complete search history.

(56) References Cited

U.S. PATENT DOCUMENTS

| | | | | |
|---|---|---|---|---|
| 3,713,744 | A * | 1/1973 | Sims | A47L 13/22 15/144.2 |
| 6,010,268 | A | 1/2000 | Sereg | |
| 7,040,830 | B2 | 5/2006 | Kliegman | |
| D554,314 | S | 10/2007 | Kubes | |
| 2003/0229958 | A1 | 12/2003 | Thompson | |
| 2004/0019995 | A1 | 2/2004 | Kowalski | |
| 2006/0085935 | A1 * | 4/2006 | White | 15/228 |
| 2006/0200929 | A1 | 9/2006 | Knopow | |

(Continued)

FOREIGN PATENT DOCUMENTS

NL 8 202 730 2/1984

OTHER PUBLICATIONS

PCT International Search Report for PCT/US2013/049718 mailed Sep. 30, 2013.
Quickie Mfg—Lysol Scrub Dishwand 57161. Photo. Online. Apr. 3, 2013 <www.midlandhardware.com/zoomify.asp?catalogid=215066&img=/assets/images/products/137286.jpg>.

(Continued)

*Primary Examiner* — Mark A Laurenzi
*Assistant Examiner* — Bradley Oliver

(57) ABSTRACT

The disclosed cleaning element, which may be secured to a cleaning tool, includes a cleaning material that continuously curves from a first working surface to a second working surface allowing for easy cleaning of sharply curving surface, such as, for example, bowls and cups. Also disclosed is a method of making a continuously curving cleaning element.

18 Claims, 2 Drawing Sheets

(56) References Cited

U.S. PATENT DOCUMENTS

| | | | |
|---|---|---|---|
| 2008/0098546 | A1 | 5/2008 | Warmka |
| 2009/0032059 | A1 | 2/2009 | Tuman |
| 2009/0038092 | A1 | 2/2009 | Kennedy |
| 2010/0017992 | A1 | 1/2010 | Sgroi, Jr. |

OTHER PUBLICATIONS

Homepro, Clean Smart, Quickie, Reach'n Scrub "Curved to scrub those hard to reach places"—Advertisement Photo.
Supplementary European Search Report in European Patent Application No. 13 81 6735, dated Feb. 25, 2016.

* cited by examiner

CONTINUOUSLY CURVING CLEANING ELEMENT

CROSS REFERENCE TO RELATED CASES

This application claims priority to U.S. provisional application 61/669,899 filed on Jul. 10, 2012.

FIELD

The present disclosure relates to a cleaning element. In particular, the present disclosure relates to a cleaning element that comprises a curved section of a sponge.

BACKGROUND

Hand held cleaning tools are commonly used for cleaning dishes, bathrooms, walls, showers. Hand held cleaning tools may have bristles for cleaning. Some hand held cleaning tools have a foam head that might also have scouring abilities. A dish wand is one specific hand held cleaning tool used for washing dishes. A dish wand commonly has a handle that can hold soap and a working head that includes a foam and a scouring portion. One specific example of a commonly used hand held cleaning tool with a foam head is a Scotch-Brite™ Dishwand, available from 3M Company, St. Paul Minn. The soap contained within the dish wand will sometimes seep out of the porous portion of the foam. Also, the dish wands are very useful for cleaning flat or slightly curved surfaces, like plates. However, dish wands are not as easily used for very curved surfaces like small bowls or cups.

SUMMARY

The disclosed cleaning element, which may be secured to a cleaning tool, includes a cleaning material that continuously curves from a first working surface to a second working surface allowing for easy cleaning of sharply curving surface, such as, for example, bowls and cups. Also disclosed is a method of making a continuously curving cleaning element.

In one embodiment, a cleaning element comprises a support comprising a first portion and second portion, wherein the support includes a slot for receiving separate attachment device, a cleaning material having a first working surface secured to the first portion of the support and a second working surface secured to the second portion of the support. The first working surface continuously curves to the second working surface forming a curving portion between.

In one embodiment, a cleaning tool comprises a handle with a holding end and a working end, wherein the working end comprises a first attachment, a support comprising a first portion and second portion, wherein the support connects with the first attachment, and a cleaning material having a first working surface secured to the first portion of the support and a second working surface secured to the second portion of the support. The first working surface continuously curves to the second working surface forming a curving portion between.

In one embodiment, the handle comprises a receptacle for holding a liquid. In one embodiment the handles comprises a passage from the receptacle to the cleaning element. In one embodiment, the handle comprises a deformable actuator for forcing liquid from the receptacle out the passage. In one embodiment, the support comprises a slot with a flexible guard for receiving the first attachment and wherein the flexible guard wraps adjacent the working end of the handle. In one embodiment, the first portion of the support comprises a first connector and the second portion of the support comprises a second connector for receiving the first connector. In one embodiment, the first connector and second connector provide for a secure, interlocking connection. In one embodiment, the first connector can be removably connected with the second connector. In one embodiment, the support further comprises a hinge between the first portion and second portion of the support. In one embodiment, the first working surface comprises a first width and the second working surface comprises a second width, wherein the first width is greater than the second width. In one embodiment, the cleaning material continuously curves at least 45 degrees, as measured by the angle formed through the cleaning material by the first working surface and second working surface. In one embodiment, the cleaning material continuously curved less than 180 degrees, as measured by the angle formed through the cleaning material by the first working surface and second working surface.

In one embodiment, a method of forming a continuously curved cleaning material comprises securing a cleaning material to a support adjacent a first connector and adjacent a second connector and securing the first connector on the support to the second connector on the support, which forms a curved portion of the cleaning material. In one embodiment, the first connector and second connector form a secure, interlocking connection. In one embodiment, the first connector is removable from the second connector. In one embodiment, the securing the cleaning material step further comprises securing a planar cleaning material to a support.

While the above-identified drawings and figures set forth embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of this invention.

The figures may not be drawn to scale.

DETAILED DESCRIPTION

Figure 1:
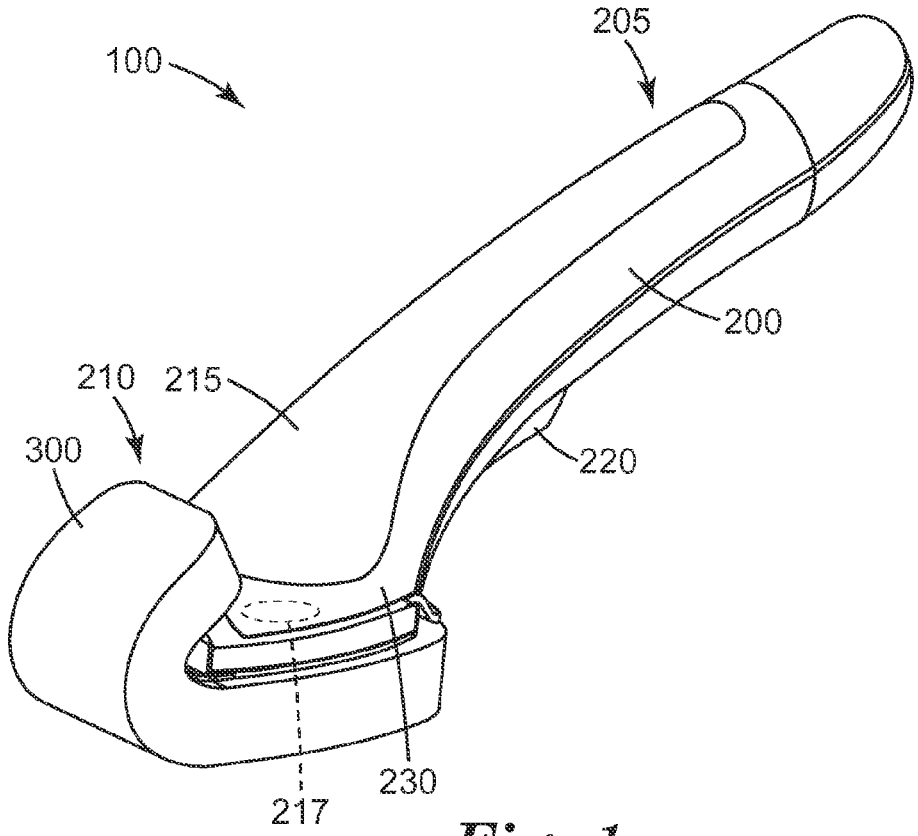
FIG. 1 is a perspective view of one embodiment of a cleaning element attached to a cleaning tool.
Figure 2:
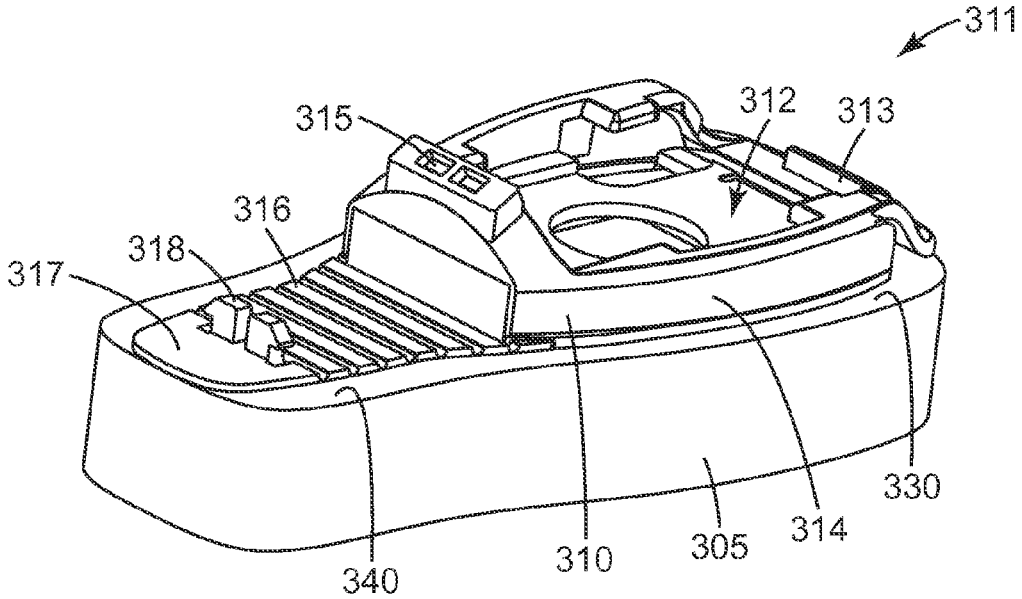
FIG. 2 is a perspective view of an embodiment of the cleaning element, wherein the working surface is planar.
Figure 3:
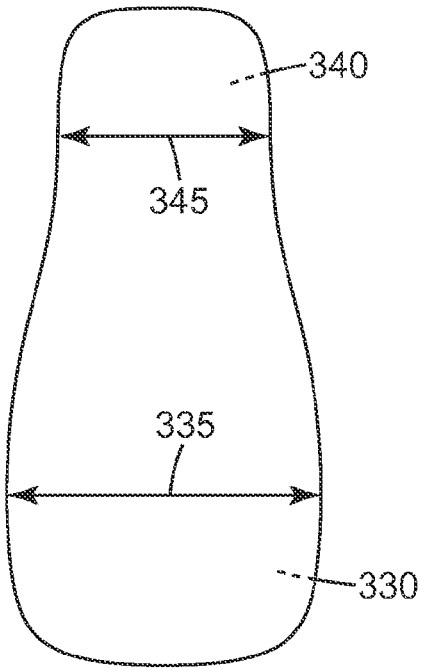
FIG. 3 is a bottom view of the cleaning element of FIG. 2.
Figure 4:
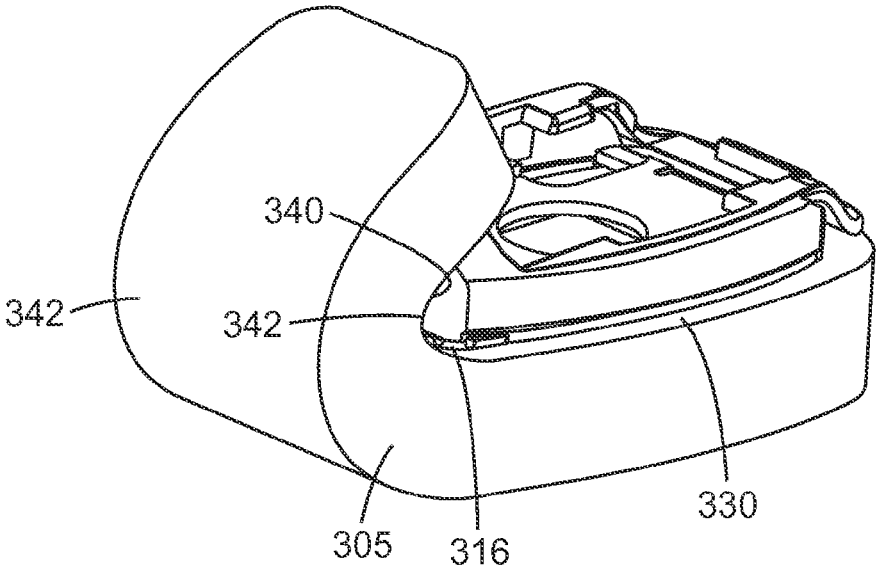
FIG. 4 is a perspective view of the cleaning element of FIG. 2, wherein the working surface is curved.

FIG. 1 is a perspective view of one embodiment of a cleaning tool 100 with an attached cleaning element 300. FIG. 2 is a perspective view of an embodiment of the cleaning element 300, wherein the working surface is planar. FIG. 3 is a bottom view of the cleaning element 300 of FIG. 2. FIG. 4 is a perspective view of the cleaning element 300 of FIG. 2, wherein the working surface is curved.

The cleaning tool 100 comprises a handle 200 with a holding end 205 and a working end 210. The working end 210 includes a first attachment 230 for connection with a second attachment 311 (discussed below) on the cleaning element 300. In one embodiment the handle 200 includes a receptacle 215 for holding a liquid, such as, for example, liquid dish soap. To aid in dispensing the dish soap from the receptacle 215 to the cleaning element 300, the handle includes a passage 217. In one embodiment, to prevent continuous leaking of the liquid contained within the receptacle, the handle may include a valve at the passage 217 to hold the liquid in the handle until sufficient pressure is placed against the valve. The pressure may come from deformation of an actuator 220. In this embodiment, the actuator 220 is deformable and is located on the underside of the handle 200. Therefore, when the handle 200 is being held a users index finger is able to easily deform the actuator 220, which in turn forces liquid from the valve out the passage 217. From the passage 217, the liquid will enter into the cleaning element 300. The cleaning element 300 may itself include through passages to further aid in the fast release of the dispensed liquid from the handle 200 to the surface being cleaned.

The cleaning element 300 includes a cleaning material 305 secured to a support 310. In this embodiment, the support 310 also serves as the second attachment 311, for attachment with the first attachment 230. Generally, the support 310 is made from a relatively rigid material so that secure attachment is formed when the first attachment 230 and second attachment 311 attach together.

In the embodiment shown, the second attachment 311 includes a slot 312 for receiving the first attachment 230 and includes a guard 313. The guard 313 is deformable so that is can be pressed down to allow for the first attachment 230 to slide in and out of the second attachment 311. When the guard 313 is in place, it securely wraps around the entire backside of the working end 210 of the handle 200 to provide a secure connection between the cleaning element 300 and handle 200.

In the embodiment show, the support 310 includes a first portion 314 having a first connector 315 and a second portion 317 having a second connector 318 separated from one another by a hinge 316. The first connector 315 and second connector 318 connect together. In one embodiment, the first connector 315 and second connector 318 form a secure, interlocking connection. In one embodiment, the first connector 315 can be releasably connected to the second connector 318. When the first connector 315 secures with the second connector 318, the hinge 316 will bend and a curved surface of the attached cleaning material 305 is formed, such as shown in FIGS. 1 and 4.

The hinge 316 provides flexing between the first connector 315 and second connector 318. The hinge 316 can be a living hinge, a thinner or weaker section of the support 310, or a more flexible material than the support 310. The cleaning material 305 is at least secured to a portion of the support 310 adjacent the first connector 315 and a portion of the support 310 adjacent the second connector 318 so that when engaged together a curved surface of the attached cleaning material 305 is formed.

In FIG. 2, the support 310 is flat, which allows for simplified manufacturing for securing to the cleaning material 305. During assembly, the support 310 is bent at the hinge 216 and the first and second connectors 315, 318 interlock, such as shown in FIG. 4. For simplified manufacturing, it is desirable to provide the cleaning material 305 on to the support 310 in a single plane such as shown in FIG. 2, and then separately curving the surface.

It is understood that although an embodiment of the support 310 is described that include a flexing hinge 316 and first and second connectors 315, 318, a curved cleaning material 305 could be made by having a fixed support 310 having a first portion 314 to which the flexible cleaning material 305 is secured, wrapped, and secured to a second portion 317. In such an embodiment, a hinge 316 between the first portion 314 and second portion 317 maybe optional. Securement of the cleaning material 305 could be though commonly used securement mechanisms such as adhesive or melt bonding.

The curved cleaning element 300 includes a first working surface 330 and second working surface 340. A curving portion 342 of the second working surface 340 curves and wraps to connect with the first working surface 330. Generally, the first working surface 330 is adjacent the first connector 315, and the second working surface 340 is adjacent the second connector 318. In one embodiment, the cleaning material 305 continuously curves at least 45 degrees, as measured by the angle formed through the cleaning material 305 by the first working surface 330 and second working surface 340. In one embodiment, the cleaning material 305 continuously curves at least 90 degrees, as measured by the angle formed through the cleaning material 305 by the first working surface 330 and second working surface 340. In one embodiment, the cleaning material 305 continuously curves less than 180 degrees, as measured by the angle formed through the cleaning material 305 by the first working surface 330 and second working surface 340.

In one embodiment, and shown in FIG. 3, first working surface 330 has a first width 335 and the second working surface 340 has a second width 345. In this embodiment, the first width 335 is larger than the second width 345. Therefore, the curving portion 342 also has a width less than the first width 335. In one embodiment, the first width 335 is at least 10% greater than the second width 345. In one embodiment, the first width 335 is at least 25% greater than the second width 345. In one embodiment, the second width 345 is at least 30% smaller than the first width 335.

When the second width 345 is less than the first width 335, the curving portion 342 of the second working surface 340 that aligns with the hinge 316 is narrower than the first working surface 330. Therefore, the curving portion 342 is better able to fit into small, curving areas of items being clean, like the bottom of a glass or bowl.

The cleaning material 305 can comprise foam, sponge, nonwoven fabric, knitted fabric, woven fabric, or combinations of one or more thereof. In one embodiment, the cleaning material 305 is a foam or sponge, with a souring layer secured to the foam or sponge at the outermost working surfaces. The cleaning material 305 can be secured to the connector 310 by a variety of mechanisms such as adhesive or melt bonding.

It is understood that the curved cleaning element 300 may be secured to a separate cleaning tool 100 which includes a handle or may be independently used for cleaning. Further if used with a cleaning tool 100, any variety of sizes and shapes of cleaning tools could be used and any specific types of attachment mechanisms could be used for securing the cleaning element 300 to the cleaning tool 100.

The disclosed curved cleaning element and method of making the cleaning element provide for a continuously curved working surface useful for cleaning sharply curving surfaces such a bowls or cups.

Although specific embodiments of this invention have been shown and described herein, it is understood that these embodiments are merely illustrative of the many possible specific arrangements that can be devised in application of the principles of the invention. Numerous and varied other arrangements can be devised in accordance with these principles by those of ordinary skill in the art without departing from the spirit and scope of the invention. Thus, the scope of the present invention should not be limited to the structures described in this application, but only by the structures described by the language of the claims and the equivalents of those structures.

What is claimed is:

1. A cleaning element comprising:

a support comprising a first portion and second portion, wherein the support includes a slot for receiving separate attachment device;

a cleaning material having a first working surface secured to the first portion of the support and a second working surface secured to the second portion of the support; and a hinge between the first portion and second portion;

wherein the first working surface comprises a first width and the second working surface comprises a second width, and wherein the width of the second working surface that aligns with the hinge is narrower than the width of the first working surface; and wherein the first working surface continuously curves to the second working surface forming a curving portion between.

2. The cleaning element of claim 1, wherein the second portion of the support comprises a second connector and the first portion of the support comprises a first connector for receiving the second connector.

3. The cleaning tool of claim 1, wherein the cleaning material continuously curves at least 45 degrees, as measured by the angle formed through the cleaning material by the first working surface and second working surface.

4. A dish wand comprising:

a handle with a holding end and a working end, wherein the working end comprises a first attachment;

a support comprising a first portion and second portion, wherein the support connects with the first attachment; and a cleaning material for cleaning dishware having a first working surface secured to the first portion of the support and a second working surface secured to the second portion of the support;

wherein the first working surface continuously curves to the second working surface forming a curving portion between, and wherein the second portion of the support comprises a second connector and the first portion of the support comprises a first connector for receiving the second connector.

5. The dish wand of claim 4, wherein the handle comprises a receptacle for holding a liquid.

6. The dish wand of claim 5, further comprising a passage from the receptacle to the cleaning element.

7. The dish wand of claim 5, wherein the handle comprises a deformable actuator for forcing liquid from the receptacle out the passage.

8. The dish wand of claim 4, wherein the support comprises a slot with a flexible guard for receiving the first attachment and wherein the flexible guard wraps adjacent the working end of the handle.

9. The dish wand of claim 4, wherein the first connector and second connector provide for a secure, interlocking connection.

10. The dish wand of claim 4, wherein the second connector can be removably connected with the first connector.

11. The dish wand of claim 4, further comprising a hinge between the first portion and second portion of the support.

12. The dish wand of claim 11, wherein the hinge is a living hinge.

13. The dish wand of claim 4, wherein the first working surface comprises a first width and the second working surface comprises a second width, wherein the first width is greater than the second width.

14. The dish wand of claim 4, wherein the cleaning material continuously curves at least 45 degrees, as measured by the angle formed through the cleaning material by the first working surface and second working surface.

15. The dish wand of claim 4, wherein the cleaning material continuously curves at least 90 degrees, as measured by the angle formed through the cleaning material by the first working surface and second working surface.

16. The dish wand of claim 4, wherein the cleaning material continuously curved less than 180 degrees, as measured by the angle formed through the cleaning material by the first working surface and second working surface.

17. A dish wand comprising:

a handle with a holding end and a working end, wherein the working end comprises a first attachment;

a support comprising a first portion and second portion, wherein the support connects with the first attachment;

a cleaning material for cleaning dishware having a first working surface secured to the first portion of the support and a second working surface secured to the second portion of the support; and a hinge between the first portion and second portion of the support, wherein the first working surface continuously curves to the second working surface forming a curving portion between.

18. The dish wand of claim 17, wherein the hinge is a living hinge.

* * * * *